US010954034B2

(12) United States Patent
Parve et al.

(10) Patent No.: US 10,954,034 B2
(45) Date of Patent: Mar. 23, 2021

(54) CONTAINER WITH EXPANSION PANEL

(71) Applicant: Gateway Plastics, Inc., Mequon, WI (US)

(72) Inventors: Terrence M. Parve, Menomonee Falls, WI (US); Robert E. Proudfoot, West Bend, WI (US)

(73) Assignee: Gateway Plastics, Inc., Mequon, WI (US)

( * ) Notice: Subject to any disclaimer, the term of this patent is extended or adjusted under 35 U.S.C. 154(b) by 320 days.

(21) Appl. No.: 15/818,210

(22) Filed: Nov. 20, 2017

(65) Prior Publication Data

US 2019/0152648 A1 May 23, 2019

(51) Int. Cl.

| | |
|---|---|
| ***B65D 79/00*** | (2006.01) |
| ***B65D 21/08*** | (2006.01) |
| ***B65D 25/24*** | (2006.01) |
| ***B65D 25/54*** | (2006.01) |
| ***B65D 85/00*** | (2006.01) |
| ***B65D 85/34*** | (2006.01) |
| ***B65D 1/40*** | (2006.01) |
| ***B65D 17/28*** | (2006.01) |
| *B65D 8/00* | (2006.01) |
| *B65D 17/34* | (2006.01) |

(52) U.S. Cl.

CPC ..... *B65D 21/08* (2013.01); *B65D 1/40* (2013.01); *B65D 17/4011* (2018.01); *B65D 25/24* (2013.01); *B65D 25/54* (2013.01); *B65D 79/005* (2013.01); *B65D 85/34* (2013.01); *B65D 85/70* (2013.01); *B65D 15/18* (2013.01); *B65D 17/34* (2018.01)

(58) Field of Classification Search

CPC ..... B65D 1/40; B65D 79/005
USPC ..... 220/606
See application file for complete search history.

(56) References Cited

U.S. PATENT DOCUMENTS

| | | | | |
|---|---|---|---|---|
| 4,147,271 | A * | 4/1979 | Yamaguchi | B65D 1/165 220/606 |
| 8,960,472 | B2 * | 2/2015 | Tomaru | B65D 25/14 220/600 |
| 9,027,783 | B2 * | 5/2015 | Houlton | B65D 1/26 220/609 |
| 9,463,894 | B2 * | 10/2016 | Minnette | B65D 1/40 |
| 9,957,096 | B2 * | 5/2018 | Niec | B65D 79/005 |
| 2014/0308406 | A1 * | 10/2014 | O'Brien | C08K 3/34 426/115 |

* cited by examiner

*Primary Examiner* — Anthony D Stashick
*Assistant Examiner* — Raven Collins
(74) *Attorney, Agent, or Firm* — Foley & Lardner LLP

(57) ABSTRACT

A container for a retorting process includes a body. The body is configured to be coupled to a lid such that the lid and the body define an internal volume of the container. The body includes a lip, a wall, a support, a hinge, and an expansion panel. The lip is configured to be coupled to the lid. The wall is contiguous with the lip. The support is contiguous with the wall. The support is configured to interface with a surface to support the container on the surface. The hinge is contiguous with the support opposite the wall. The expansion panel is contiguous with the hinge. The hinge is configured to facilitate displacement of the expansion panel relative to the support to selectively increase the internal volume of the container.

17 Claims, 4 Drawing Sheets

CONTAINER WITH EXPANSION PANEL

BACKGROUND

The present application relates generally to containers. In particular, this application relates to a container with an expansion panel.

Generally speaking, products may be packaged in containers. Some products are intended to be heated within the containers when the containers are closed. These containers are rigid and therefore have a substantially fixed volume. As a result of the heating, pressure within a container may increase. As a result, damage to the container may occur, a seal of the container may be compromised, and products may be unintentionally expelled from the container when the container is opened (e.g., by a user).

SUMMARY

One embodiment of the present disclosure is related to a container for a retorting process. The container includes a body. The body is configured to be coupled to a lid such that the lid and the body define an internal volume of the container. The body includes a lip, a wall, a support, a hinge, and an expansion panel. The lip is configured to be coupled to the lid. The wall is contiguous with the lip. The support is contiguous with the wall. The support is configured to interface with a surface to support the container on the surface. The hinge is contiguous with the support opposite the wall. The expansion panel is contiguous with the hinge. The hinge is configured to facilitate displacement of the expansion panel relative to the support to selectively increase the internal volume of the container.

Another embodiment of the present disclosure is related to a container. The container includes a body. The body is configured to be coupled to a lid such that the lid and the body define an internal volume of the container. The body includes a wall, a support, an expansion panel, and a hinge. The support is contiguous with the wall. The support is configured to interface with a surface to support the container on the surface. The expansion panel is operable between a first position, where the container has a first volume and the expansion panel is convex with respect to the lid, and a second position, where the container has a second volume greater than the first volume and the expansion panel is concave with respect to the lid in the second position. The hinge is contiguous with the support opposite the wall and contiguous with the expansion panel. The hinge is configured to facilitate displacement of the expansion panel relative to the support to selectively increase the internal volume of the container and to limit displacement of the expansion panel such that the expansion panel is spaced from the surface when the internal volume of the container is equal to a maximum volume of the container and the support interfaces with the surface.

Yet another embodiment of the present disclosure is related to a container. The container includes a body. The body is configured to be coupled to a lid such that the lid and the body define an internal volume of the container. The body includes a wall, a support, an expansion panel, and a hinge. The support is contiguous with the wall. The support is configured to interface with a surface to support the container on the surface. The expansion panel defines a centroid, having a diameter, d, bisecting the expansion panel. The expansion panel is operable between a first position, where the container has a first volume and the expansion panel is convex with respect to the lid, and a second position, where the container has a second volume greater than the first volume and the expansion panel is concave with respect to the lid in the second position. The hinge is disposed along a plane and contiguous with the support opposite the wall and contiguous with the expansion panel. The hinge is configured to facilitate displacement of the expansion panel relative to the support to selectively increase the internal volume of the container. The expansion panel is configured such that the centroid is spaced from the plane a distance t when the expansion panel is in the first position. The container is configured such that $0.03d \leq t \leq 0.05d$. The wall, the support, the hinge, and the expansion panel are centered about a central axis. The expansion panel is configured such that the centroid is translated along the central axis as the expansion panel transitions between the first position and the second position.

It is to be understood that both the foregoing general description and the following detailed description are exemplary and explanatory only and are not restrictive of the invention as claimed.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Products (e.g., fresh food, processed food, fish, meat, fruits, vegetables, etc.) may be cooked, packaged, and preserved through a retorting process. The retorting process begins with first cooking the products. For example, fish may be cooked from a raw state to a cooked state. The products are then placed in containers, and the containers are sealed. In many applications the containers are vacuum sealed. Next, the containers are heated, such as through a flash cooking or sterilization process (e.g., to perform pasteurization, to kill germs or bacteria, etc.). The containers may also be heated via microwaving.

A sealed container typically has a fixed volume. As a result, heating such a container causes pressure within the container to increase. This increased pressure can cause a seal of the container to become compromised, the container to experience deformation (e.g., bulging, etc.), and/or a lid of the container to become displaced. The seal facilitates long term storage of the sealed container, such as for many weeks or months. Therefore, the products contained therein may spoil if the seal is compromised through the heating of the sealed containers. Bulging of a container is not aesthetically or commercially appealing and may adversely affect stackability of containers. Accordingly, it is important to perform the heating process such that the seal is maintained.

To combat increases in pressure within containers during heating, retorting processes may utilize a pressure chamber (e.g., autoclave, etc.) within which the containers are placed during heating. The pressure chamber pressurizes an outside surface of the containers to balance against pressure increases inside the containers. However, the pressure chamber is relatively expensive to purchase, operate, and maintain. Additionally, use of the pressure chamber increases production time associated with producing the containers. Thus, an opportunity exists for mitigating pressure increases that occur within containers during the heating in a retorting process without the use of a pressure chamber or any other additional or specialized equipment.

Figure 1:
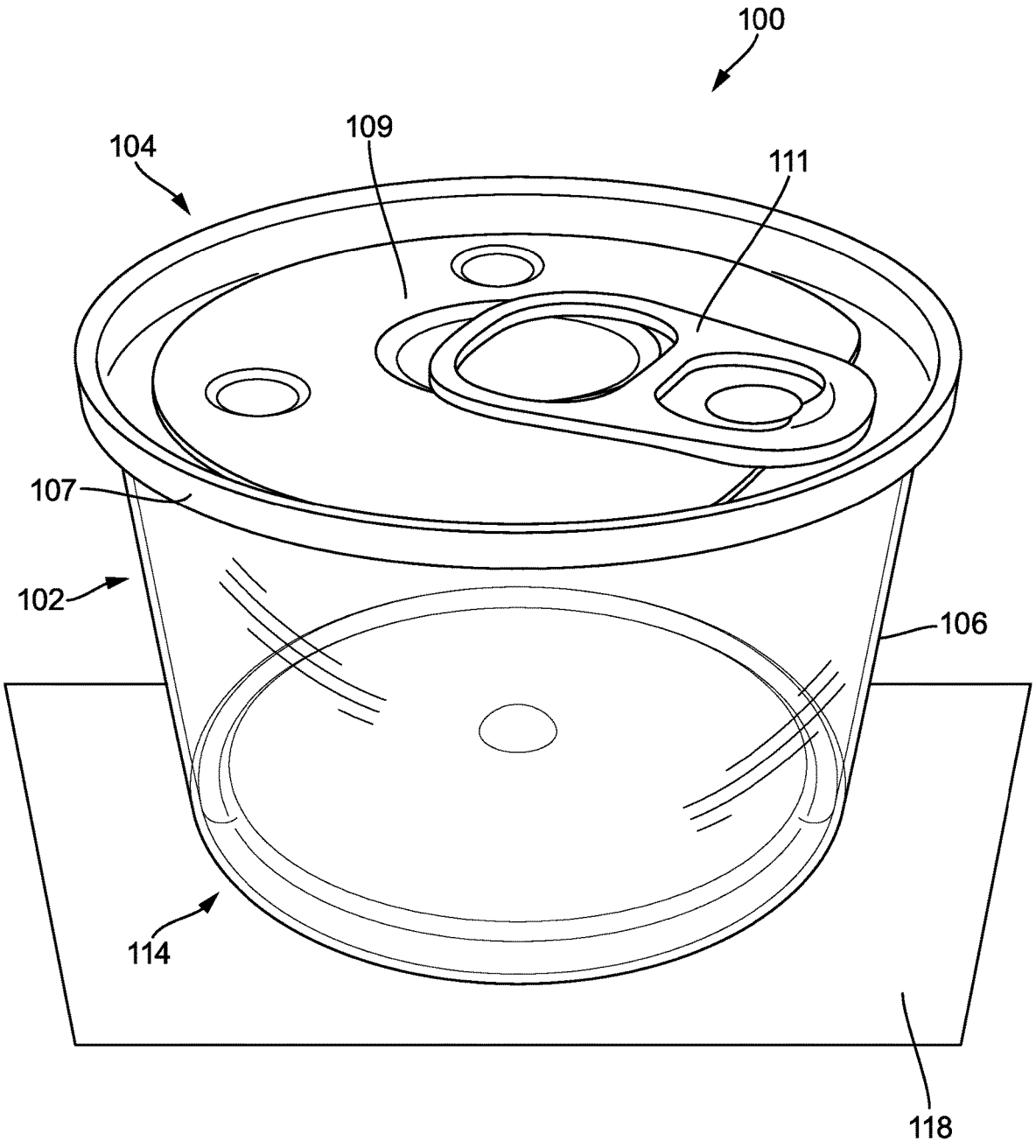
FIG. 1 is a top perspective view of a container, according to an exemplary embodiment of the present disclosure.
Figure 2:
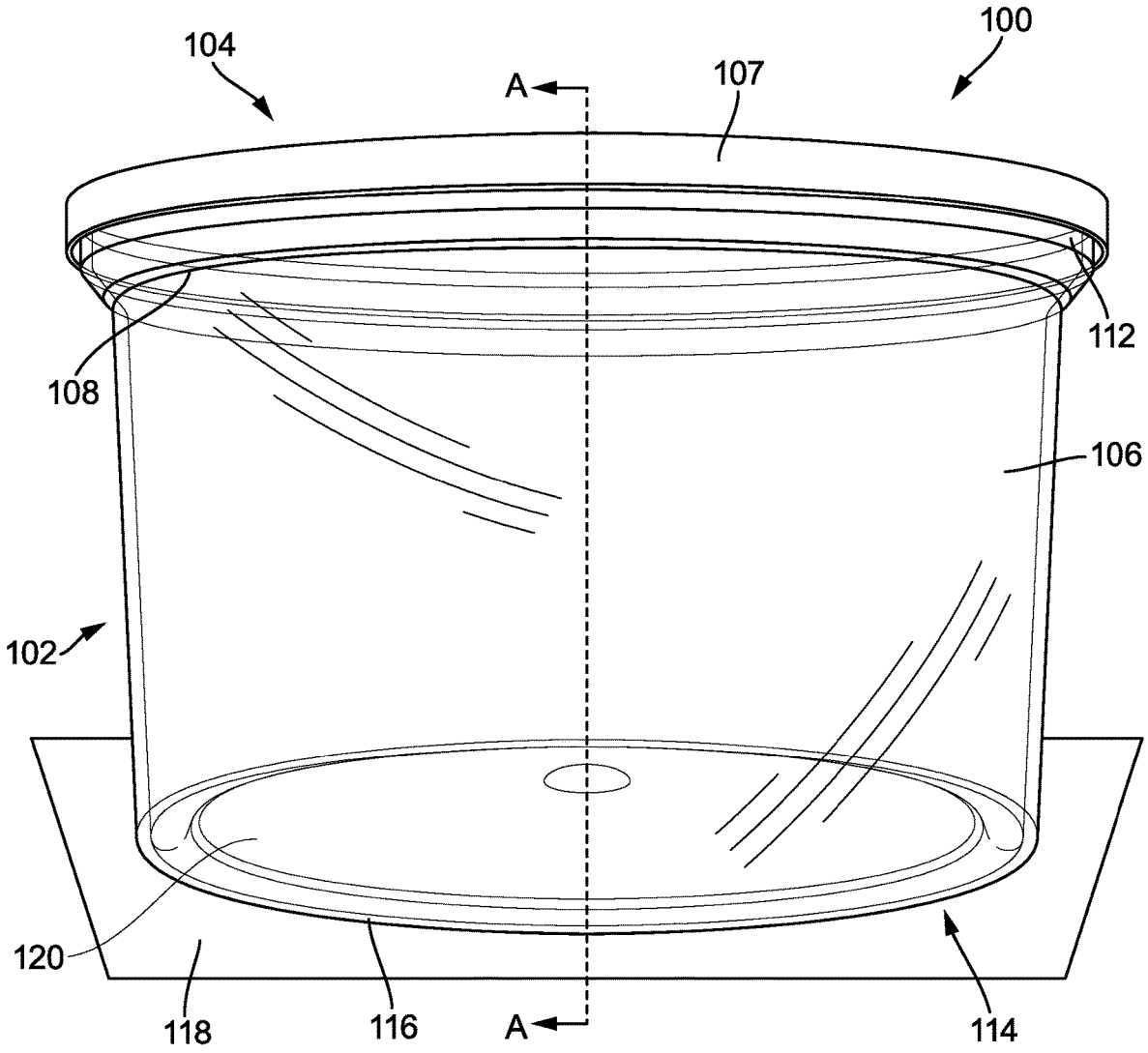
FIG. 2 is a front view of the container shown in FIG. 1.

Referring to FIG. 1, a container (e.g., can, package, jar, etc.), shown as a container 100, includes a body (e.g., frame, shell, etc.), shown as a body 102, and a lid (e.g., closure, cap, etc.), shown as a lid 104. The container 100 is utilized to selectively contain (e.g., store, encapsulate, protect, seal, preserve, etc.) products. For example, the container 100 may be sold to a supermarket and subsequently purchased by a consumer. In an exemplary embodiment, the container 100 is utilized for the containment of cooked fish (e.g., tuna, salmon, etc.). As will be explained in more detail herein, the container 100 is configured to mitigate increases in internal pressure of the container in the first state by selectively expanding an internal volume of the container 100.

The lid 104 is sealed to the body 102. For example, the lid 104 may be a pull tab lid. In another example, the lid 104 is applied via a vacuum sealer to the body 102. Once the lid 104 is removed from the body 102, the lid 104 may be discarded (e.g., if the lid 104 is a single use lid or a pull tab lid, etc.) or reapplied (e.g., if the lid 104 is a resealable or multi-use lid, etc.).

In an exemplary embodiment, the body 102 is constructed from transparent or translucent plastic and the lid 104 is constructed from aluminum. The transparency or translucency of the body 102 may facilitate visualization of products within the container 100. For example, a user may be able to look through the body 102 to determine an amount of products remaining in the container 100, a pleasing visual appearance of product quality, or type of products in the container 100. The body 102 may be constructed from various plastics, polymers, resins, or other similar materials. In other applications, the body 102 may be opaque or metallic. For example, the body 102 may be constructed from aluminum. In still other applications, the body 102 and/or the lid 104 may be constructed from plastic, stainless steel, an aluminum alloy, or other similar metals. In an exemplary embodiment, the lid 104 is constructed from plastic and the lid 104 is coupled to the body 102 using suitable manufacturing processes.

The body 102 includes a wall (e.g., side, etc.), shown as a wall 106. In an exemplary embodiment, the wall 106 is cylindrical. However, in some applications, the wall 106 may be frustoconical, prismatic, rectangular, square, hexagonal, or otherwise shaped. The wall 106 is centered about an axis, shown as a central axis 105. In various embodiments, the wall 106 is symmetrical. For example, the wall 106 may be symmetrical about a plane along which the central axis 105 is disposed. The wall 106 includes a first edge (e.g., end, etc.), shown as a top edge 108, and a second edge, shown as a bottom edge 110, opposite the top edge 108.

The body 102 further includes a lip (e.g., projection, supporting structure, etc.), shown as a lip 112, which extends from and along the top edge 108 of the wall 106 and is configured to selectively interface with the lid 104. As will be explained in more detail herein, the lid 104 may be rolled over the lip 112 such that the lid 104 is coupled (e.g., attached, secured, affixed, etc.) to the body 102. The lip 112 defines an opening, shown as a central opening 113, of the body 102. The lip 112 is configured such that the lid 104 covers the central opening 113 when the lid 104 is coupled to the body 102.

In an exemplary embodiment, the lid 104 includes a rim, shown as a rim 107, and a panel, shown as a removable panel 109. The rim 107 of the lid 104 is sealed to (e.g., rolled onto, etc.) the lip 112 of the body 102. The removable panel 109 is coupled to the rim 107 of the lid 104. For example, the removable panel 109 may be separated from the rim 107 of the lid 104 by a line of weakness configured to facilitate removal of the removable panel 109 from the rim 107 of the lid 104. The removable panel 109 includes a tab, shown as a pull tab 111. The pull tab 111 is configured to be grasped by a user to remove the removable panel 109 from the rim 107, thereby exposing the central opening 113.

The body 102 also includes a base (e.g., bottom, etc.), shown as a base 114, which extends from and along the bottom edge 110 of the wall 106. The base 114 includes a support (e.g., ring, etc.), shown as a support 116, which is contiguous with the bottom edge 110 of the wall 106. The support 116 is configured to selectively interface with a surface (e.g., shelf, ground, countertop, rack, etc.), shown as a surface 118. For example, the support 116 is configured to support the container 100 on the surface 118.

The container 100, when filled with products and sealed, is defined by a product expansion temperature. When the container 100 exceeds the product expansion temperature, a volume of the products within the container 100 has increased above a volume threshold at which an appreciable increase in the volume of the products within the container 100 has occurred. As the temperature of the container 100 continues to increase above the expansion temperature, the volume of the products within the container will correspondingly continue to increase above the volume threshold.

TABLE 1

Overview of Expansion Temperature.

| Temperature of the Container 100 | Volume of the Products within the Container 100 |
|---|---|
| $T_1 \leq T_{Expansion}$ | $V_1 \leq V_{Threshold}$ |
| $T_2 > T_{Expansion}$ | $V_2 > V_{Threshold}$ |

The expansion temperature is a function of the products sealed within the container 100. For example, the expansion temperature may vary based on, for example, a configuration of the products inside the container 100 (e.g., a volume of the products, a type of the products, etc.). The volume threshold may be, for example, a multiple (e.g., 1.05, 1.1, 1.15, 1.2, 1.5, 1.75, 2, 3, etc.) of a volume of the products sealed within the container 100 when the products are at room temperature.

The base 114 further includes a panel (e.g., wall, etc.), shown as an expansion panel 120, that is contiguous with the support 116 along a junction (e.g., boundary, etc.), shown as a hinge 121. The expansion panel 120 is resiliently deformable and configured to be displaced relative to the support 116. Displacement of the expansion panel 120 relative to the support 116 is facilitated by the hinge 121. The hinge 121 may have a thickness that is less than a thickness of the wall 106, the support 116, or the expansion panel 120.

The container 100 is configured such that pressure increases within the container 100 cause the expansion panel 120 to be displaced outward (e.g., towards the surface 118, etc.), thereby increasing an internal volume of the container 100. In this way, the expansion panel 120 accommodates expansion of the container 100 thereby mitigating internal pressure increases that occur within the container 100, such as when the container 100 is heated.

Figure 3:
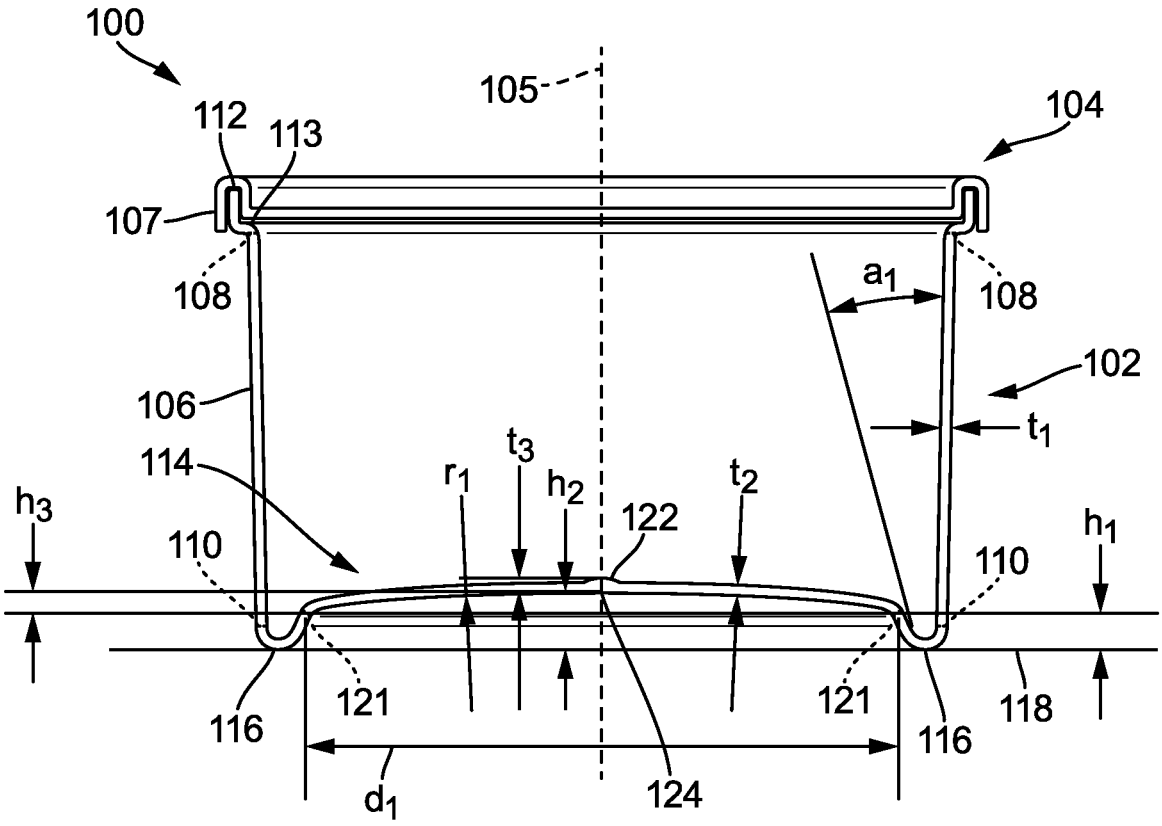
FIG. 3 is a cross-sectional view of the container shown in FIG. 2 taken about line A-A in a first state.
Figure 4:
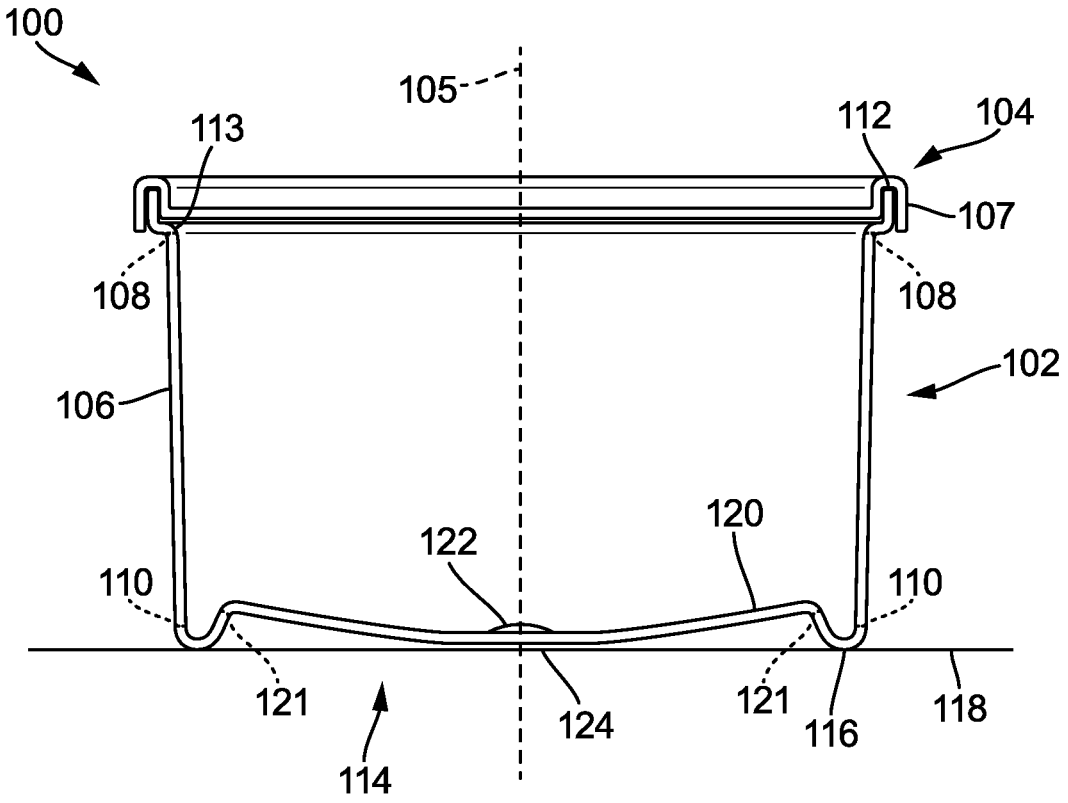
FIG. 4 is a cross-sectional view of the container shown in FIG. 2 taken about line A-A in a second state.

The expansion panel 120 is operable between a first position, shown in FIG. 3, where the internal volume of the container 100 is at a fill volume, and a second position, shown in FIG. 4, where the internal volume of the container 100 is at a maximum volume. The expansion panel 120 is in the first position whenever the temperature of the container 100 is at or below a threshold temperature and is in the second position whenever the temperature of the container 100 is above the threshold temperature.

The expansion panel 120 may be at the first position when the container 100 is at room temperature that is less than or equal to the threshold temperature. For example, the container 100 may be at room temperature after a lid has been sealed to the container and the container 100 is traveling along an assembly line prior to flash cooking. In the first position, the expansion panel 120 is generally convex relative to the container 100. In other embodiments, the expansion panel 120 may be configured to be generally horizontal (e.g., orthogonal to the wall 106, etc.) when the container 100 is in the first position.

The expansion panel 120 may be at the second position when the container 100 has been heated to an elevated temperature which is greater than the threshold temperature. For example, the container 100 may be at the second position after the container 100 has been flash cooked in a retorting process. In the second position, the expansion panel 120 is generally concave relative to the container 100. In other embodiments, the expansion panel 120 may be configured to deform towards the surface 118 when the container 100 is in the second position such that the expansion panel 120 is generally horizontal. In an exemplary embodiment, the expansion panel 120 is configured such that, at the second position, the expansion panel 120 does not bias the container 100 relative to the surface 118 and the support 116 is configured to rest (e.g., lie, etc.) flush on the surface 118. For example, the expansion panel 120 may not contact the surface 118 when the expansion panel 120 is in the second position.

TABLE 2

Overview of Operation of the Expansion Panel 120.

| Position of the Expansion Panel 120 | Temperature of the Container 100 | Pressure Within the Container 100 | Internal Volume of the Container 100 |
|---|---|---|---|
| First Position | $T_1 \leq T_{Threshold}$ | $P_1$ | $V_{Fill}$ |
| Second Position | $T_2 > T_{Threshold}$ | $P_2 \geq P_1$ | $V_{Maximum} \geq V_2 \geq V_{Fill}$ |

The body 102 may be constructed to provide a target threshold temperature to facilitate expansion of the internal volume of the container 100 at an optimal temperature. For example, the threshold temperature of the body 102 may be varied by changing the material that the body 102 is constructed from, the thickness of the expansion panel 120, the thickness of the hinge 121, and/or the configuration of the support 116. In one example, as the configuration of the body 102 changes (e.g., as the wall 106 becomes thinner, etc.) and the coefficient of thermal conductivity of the body 102 increases, the threshold temperature decreases. In another example, as the configuration of the body 102 changes (e.g., as the wall 106 becomes thicker, etc.) and the coefficient of thermal conductivity of the body 102 decreases, the threshold temperature increases.

The target threshold temperature may be selected based on the expansion temperature and/or the threshold volume of the products within the container 100. For example, as the threshold volume and/or the expansion temperature increase, the threshold temperature may be similarly increased. In another example, as the threshold volume and/or the expansion volume decrease, the threshold temperature may be similarly decreased. In this way, the container 100 may be tailored for use with a target product through changes in the configuration of the container 100. The container 100 can thus be offered to a customer in a variety of different configurations, each having different threshold temperatures and/or internal volumes, such that the customer can select the container 100 most appropriate for products produced by the customer.

In one example, the container 100 may be configured to have a threshold temperature less than approximately two-hundred and forty degrees Fahrenheit. Following this example, the container 100 may be configured to be maintained above the threshold temperature for approximately fifteen to twenty minutes during a sterilization process to substantially neutralize germs or bacteria in the products. During this time, the expansion panel 120 may be displaced outwards to mitigate pressure increases within the container 100.

In an exemplary embodiment, the wall 106 and the support 116 are annular and the expansion panel 120 is circular such that the wall 106, the support 116, and the expansion panel 120 are homocentric. The base 114 also includes a deposit (e.g., dot, button, etc.), shown as an injection button 122 disposed on the expansion panel 120 and centered on the central axis 105. In an exemplary embodiment, the wall 106, the support 116, and the expansion panel 120 are circular and homocentric with the injection button 122 positioned at a centroid of the wall 106, the support 116, and the expansion panel 120. The injection button 122 may assist in co-injection when the container 100 is constructed.

An exemplary embodiment of a construction of the container 100 will now be described in greater detail. It is understood that other similar constructions of the container 100 are similarly possible and within the scope of the present disclosure.

The wall 106 is defined by a thickness, $t_1$. In an exemplary embodiment, $t_1$ is 0.03 inches. In an example embodiment, a thickness of the wall 106 is equal to a thickness of the support 116. The wall 106 may gradually taper inwards from the top edge 108 to the bottom edge 110.

In an exemplary embodiment the support 116 is formed along a consistent (e.g., full, etc.) radius from the wall 106 to the hinge 121. The support 116 is defined by a height, $h_1$, from the hinge 121 to the surface 118. Because the support 116 is intended to be rigid, $h_1$ is intended to remain constant as the expansion panel 120 is displaced. In an exemplary embodiment, $h_1$ is 0.124 inches. The support 116 is also defined by an angle, $a_1$, of the hinge 121 from the wall 106. In various embodiments, $a_1$ is between fifteen and twenty degrees, inclusive. In an exemplary embodiment, $a_1$ is sixteen degrees.

The expansion panel 120 is defined by a diameter, $d_1$, along an axis bisecting the expansion panel 120 from one side of the hinge 121 to another side of the hinge 121. In an exemplary embodiment, $d_1$ is 2.053 inches. The expansion panel 120 is also defined by a thickness, $t_2$. In an exemplary embodiment, $t_2$ is 0.032 inches. When the expansion panel 120 is in the first position, where the temperature of the container 100 is less than or equal to the threshold temperature, the expansion panel 120 is defined by a height, $h_2$, from the surface 118 to a centroid, shown as a centroid 124, of the expansion panel 120 (e.g., a location on the expansion panel 120 on the central axis 105 but not on the injection button 122, etc.). In an exemplary embodiment, $h_2$ is 0.194 inches. The expansion panel 120 is also defined by a second height, $h_3$, from the hinge 121 to the centroid 124 of the expansion panel 120 when the expansion panel 120 is in the first position. In various embodiments, $h_3$ is three to five percent, inclusive, of $d_1$. In some embodiments, $h_3$ is less than or equal to five percent of $d_1$. In an exemplary embodiment, $h_3$ is 0.07 inches. The expansion panel 120 is also defined by a radius, $r_1$, when the expansion panel 120 is in the first position. In an exemplary embodiment, $r_1$ is 7.528 inches. In some embodiments, $3.6d_1 \leq r_1 \leq 3.7d_1$. In one embodiment, $r_1 = 3.6777d_1$.

The injection button 122 is defined by a thickness, $t_3$. In various embodiments, $t_3$ is one-hundred and thirty to one-hundred and fifty percent, inclusive, of $t_2$. In an exemplary embodiment, $t_3$ is 0.045 inches.

TABLE 3

Dimensions of the Container 100 According to Various Embodiments.

| Dimension | $t_1$ [inch] | $h_1$ [inch] | $a_1$ [degrees] | $d_1$ [inch] | $t_2$ [inch] | $h_2$ [inch] | $r_1$ [inch] | $h_3$ [inch] | $t_3$ [inch] |
|---|---|---|---|---|---|---|---|---|---|
| Value in an Exemplary Embodiment | 0.03 | 0.124 | 16 | 2.053 | 0.032 | 0.194 | 7.528 | 0.07 | 0.045 |
| Parametric Value | x | 4.13x | 533.33x | 68.43x | 1.07x | 6.46x | 250.93x | 2.33x | 1.5x |

In various embodiments, the container 100 may be reconfigured parametrically such that the container 100 is tailored for a target product and/or application. To reconfigure the container 100 parametrically, a single dimension, known as a parameter, serves as the basis for computing the other dimensions, which are computed as functions of the parameter. In Table 3, above, the parameter is $t_1$. It is understood that other parameters (e.g., $h_1$, $a_1$, $d_1$, $t_2$, $h_2$, $r_1$, $h_3$, $t_3$, etc.) could similarly be used. Parametric reconfiguration of the container 100 allows for rapid scaling of the container 100. Because the thickness, $t_1$, of the wall 106 is very influential when determining the coefficient of thermal conductivity of the container 100, and thereby how easily heat transfers into the container 100, parametric equations where $t_1$ is the parameter, as outlined in Table 3, could be used to determine the dimensions of the container 100 based on the threshold temperature and further based on the expansion temperature and volume threshold of the products within the container 100. In this way, knowledge of the expansion temperature and volume threshold for the products within the container 100 can be readily correlated to dimensions for the container 100.

While the container 100 has been described with relation to use in a retorting process, it is understood that the container 100 may be utilized in various situations where a sealed container is heated. For example, the container 100 may not be heated in a retorting process, and may instead be heated by a consumer (e.g., in a microwave, etc.). In one example, the container 100 may be utilized to contain a popcorn mixture. Following this example, a consumer may place the container 100 in a microwave, heat the container 100 in the microwave, remove the container 100 from the microwave, and open the container 100. Due to the expansion panel 120, and the various construction of the container 100, pressure increases within the container 100 were substantially mitigated during the heating in the microwave, thereby reducing depressurization that occurs when the container 100 is opened. As a result, the container 100 may protect the user from expulsion of the popcorn mixture from the container 100 upon opening of the container 100, among other similar benefits.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The term "coupled" and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements, values, or parameters in the FIGURES. It should be noted that the orientation of various elements may differ according to other exemplary embodiments and that such variations are intended to be encompassed by the present disclosure.

The construction and arrangement of the elements of the container 100 and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions, and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

What is claimed is:

1. A container for a retorting process, the container comprising:

a plastic body configured to be coupled to a lid such that the lid and the plastic body define an internal volume of the container, the plastic body comprising:

a lip configured to be coupled to the lid;

a wall contiguous with the lip;

a support contiguous with the wall, the support configured to interface with a flat surface to support the container on the flat surface;

a hinge contiguous with the support opposite the wall and separated from the wall by the support; and an expansion panel contiguous with the hinge;

wherein the hinge is configured to facilitate displacement of the expansion panel relative to the support to selectively increase the internal volume of the container;

wherein the hinge is configured to limit displacement of the expansion panel such that the expansion panel is spaced from the flat surface when the internal volume of the container is equal to a maximum volume of the container and the support interfaces with the flat surface;

wherein the expansion panel is operable between a first position where the container has a first volume and a second position where the container has a second volume greater than the first volume;

wherein the expansion panel has a radius of curvature, r, at a location separated from the hinge and when the expansion panel is in the first position;

wherein the expansion panel has a diameter, d, bisecting the expansion panel; and wherein the r is approximately equal to 3.7d.

2. The container of claim 1, wherein the wall is cylindrical; and wherein the wall, the support, the hinge, and the expansion panel are homocentric.

3. The container of claim 1, wherein the expansion panel is convex with respect to the lid in the first position; and wherein the expansion panel is concave with respect to the lid in the second position.

4. The container of claim 3, wherein the expansion panel defines a centroid;

wherein the hinge is disposed along a plane; and wherein the expansion panel is configured such that the centroid is spaced from the plane approximately 0.07 inches when the expansion panel is in the first position.

5. The container of claim 3, wherein the expansion panel defines a centroid;

wherein the wall, the support, the hinge, and the expansion panel are centered about a central axis; and wherein the expansion panel is configured such that the centroid is translated along the central axis as the expansion panel transitions between the first position and the second position.

6. The container of claim 3, wherein the expansion panel defines a centroid;

wherein the hinge is disposed along a plane;

wherein the expansion panel is configured such that the centroid is spaced from the plane a distance t when the expansion panel is in the first position;

wherein the expansion panel has a diameter, d, bisecting the expansion panel; and wherein $0.03d \leq t \leq 0.05d$.

7. The container of claim 6, wherein d is approximately equal to two inches.

8. The container of claim 1, wherein the expansion panel has a thickness, t;

wherein the support is configured to support the container on the flat surface such that the expansion panel is spaced from the flat surface a distance, x; and wherein $3.9t \leq x \leq 6t$.

9. The container of claim 1, wherein the support is configured such that the hinge is angled from the wall an angle of between fifteen and twenty degrees, inclusive.

10. The container of claim 9, wherein the angle is sixteen degrees.

11. A container comprising:

a plastic body configured to be coupled to a lid such that the lid and the plastic body define an internal volume of the container, the plastic body comprising:

a wall;

a support contiguous with the wall, the support configured to interface with a flat surface to support the container on the flat surface;

an expansion panel comprising a first portion and a second portion, the expansion panel operable between a first position, where the container has a first volume and the expansion panel is convex with respect to the lid, and a second position, where the container has a second volume greater than the first volume and the expansion panel is concave with respect to the lid in the second position, the second portion having a radius of curvature, r, the expansion panel having a diameter, d, the diameter bisecting the expansion panel, and the r being approximately equal to 3.7d when the expansion panel is in the first position; and a hinge contiguous with the support opposite the wall and separated from the wall by the support, the hinge contiguous with the first portion such that the first portion is located between the hinge and the second portion, the hinge configured to facilitate displacement of the expansion panel relative to the support to selectively increase the internal volume of the container and to limit displacement of the expansion panel such that the expansion panel is spaced from the flat surface when the internal volume of the container is equal to a maximum volume of the container and the support interfaces with the flat surface.

12. The container of claim 11, wherein the expansion panel defines a centroid;

wherein the hinge is disposed along a plane;

wherein the expansion panel is configured such that the centroid is spaced from the plane a distance t when the expansion panel is in the first position;

wherein the expansion panel has a diameter, d, bisecting the expansion panel; and wherein $0.03d \leq t \leq 0.05d$.

13. The container of claim 11, wherein the support is configured such that the hinge is angled from the wall an angle of between fifteen and twenty degrees, inclusive, when the expansion panel is in the first position.

14. The container of claim 13, wherein the angle is sixteen degrees.

15. A container comprising:

a body configured to be coupled to a lid such that the lid and the body define an internal volume of the container, the body comprising:

a wall;

a support contiguous with the wall, the support configured to interface with a surface to support the container on the surface;

an expansion panel defining a centroid, having a diameter, d, bisecting the expansion panel, and operable between a first position, where the container has a first volume and the expansion panel is convex with respect to the lid, and a second position, where the container has a second volume greater than the first volume and the expansion panel is concave with respect to the lid in the second position; and a hinge disposed along a plane and contiguous with the support opposite the wall and contiguous with the expansion panel, the hinge configured to facilitate displacement of the expansion panel relative to the support to selectively increase the internal volume of the container;

wherein the expansion panel is configured such that the centroid is spaced from the plane a distance, t, when the expansion panel is in the first position;

wherein $0.03d \leq t \leq 0.05d$;

wherein the wall, the support, the hinge, and the expansion panel are centered about a central axis;

wherein the expansion panel is configured such that the centroid is translated along the central axis as the expansion panel transitions between the first position and the second position;

wherein the plane is separated from the surface by a distance, $h_1$; and wherein at least one of:

$h_1 = d/16.556$; or $h_1 = t*1.771$.

16. The container of claim 15, wherein the expansion panel has a thickness, x;

wherein the support is configured to support the container on the surface such that the expansion panel is spaced from the surface a distance, y, when the expansion panel is in the first position; and wherein $3.9x \leq y \leq 6x$.

17. The container of claim 16, wherein the expansion panel has a radius of curvature, r; and wherein r is approximately equal to 3.7d, when the expansion panel is in the first position.

* * * * *